US006381875B2

(12) United States Patent
Singer et al.

(10) Patent No.: US 6,381,875 B2
(45) Date of Patent: May 7, 2002

(54) CUSHIONING SYSTEM FOR GOLF SHOES

(75) Inventors: Joel A. Singer, Quincy; Chad C. Patterson, West Springfield, both of MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

(21) Appl. No.: 09/761,507

(22) Filed: Jan. 16, 2001

Related U.S. Application Data

(63) Continuation-in-part of application No. 09/322,428, filed on May 28, 1999, now Pat. No. 6,176,025.

(60) Provisional application No. 60/201,356, filed on May 2, 2000.

(51) Int. Cl.[7] ..... A43B 13/18

(52) U.S. Cl. ..... 36/28; 36/29; 36/35 B; 36/35 R; 36/44

(58) Field of Search ..... 36/28, 29, 35 R, 36/37, 35 B, 44, 43, 71, 127

(56) References Cited

U.S. PATENT DOCUMENTS

| | | | | | |
|---|---|---|---|---|---|
| 2,347,207 | A | * | 4/1944 | Margolin | 36/44 |
| 3,492,744 | A | | 2/1970 | Bernier et al. | 36/59 |
| 3,559,308 | A | | 2/1971 | Bernier et al. | 36/2.5 |
| 4,100,686 | A | * | 7/1978 | Sgarlato et al. | 36/29 |
| 4,316,335 | A | | 2/1982 | Giese et al. | 36/129 |
| 4,580,359 | A | | 4/1986 | Kurrash et al. | 36/127 |
| 5,131,174 | A | | 7/1992 | Drew et al. | 36/35 |
| 5,152,081 | A | * | 10/1992 | Hallenbeck et al. | 36/28 |
| 5,155,927 | A | | 10/1992 | Bates et al. | 36/28 |
| 5,179,792 | A | | 1/1993 | Brantingham | 36/29 |
| 5,313,717 | A | | 5/1994 | Allen et al. | 36/28 |
| 5,435,078 | A | | 7/1995 | Pyle | 36/30 |
| 5,438,768 | A | | 8/1995 | Buerfeind | 36/44 |
| 5,575,088 | A | | 11/1996 | Allen et al. | 36/28 |
| 5,625,964 | A | | 5/1997 | Lyden et al. | 36/29 |
| 5,813,142 | A | | 9/1998 | Demon | 36/29 |
| D403,147 | S | | 12/1998 | Erickson | D2/962 |
| 5,911,491 | A | | 6/1999 | Huff | 36/17 R |
| 5,956,869 | A | * | 9/1999 | Kim | 36/29 |
| 6,038,790 | A | * | 3/2000 | Pyle et al. | 36/28 |
| 6,158,149 | A | * | 12/2000 | Rudy | 36/28 |
| 6,176,025 | B1 | * | 1/2001 | Patterson et al. | 36/28 |

FOREIGN PATENT DOCUMENTS

| | | |
|---|---|---|
| JP | 3-50103 | 3/1991 |

* cited by examiner

*Primary Examiner*—M. D. Patterson

(57) ABSTRACT

A cushioning system for golf shoe includes a footbed and a lasting board, each having a sole region, an arch region, and a heel region. The footbed includes an upper layer which is engaged by the foot of a golfer and a cushion layer composed of compressible material disposed below the upper layer which extend the length of the footbed. A rigid bottom layer is disposed below the cushion layer in the heel region. A first cushioning element is disposed within a receptacle formed in the heel region of the lasting board. A second cushioning element is disposed within a receptacle formed in the upper and cushion layers in the heel region of the footbed.

20 Claims, 4 Drawing Sheets

CUSHIONING SYSTEM FOR GOLF SHOES

This application is a continuation-in-part of copending U.S. application Ser. No. 09/322,428 filed on May 28, 1999, and claims the benefit of U.S. Provisional Application Serial No. 60/201,356, filed on May 2, 2000.

BACKGROUND OF THE INVENTION

The present invention relates to shoes, and more particularly to sports shoes intended for use while playing golf.

Golf shoes are typically comprised of a shoe upper which is attached to some or all of an inner sole, and an outsole. The inner sole typically includes a multi-layer footbed having an upper layer which is contacted by the golfer's foot and a cushioning layer composed of a compressible material. The cushioning layer is compressed at the pressure points imposed by the foot and generally absorbs some of the shock which is generated during the golf swing and walking. The thickness of the inner sole is limited by the internal volume of the golf shoe. Therefore, the thickness of the cushioning layer and the relief provided by the cushioning layer is also limited.

Recreational golfers are generally free to use motorized golf carts, thereby limiting walking related stress. However, PGA rules generally prohibit the use of such golf carts during professional golfing events. The use of motorized golf carts may also be prohibited during other golfing events such as club tournaments. The stress imposed by walking the golf course can lead to fatigue which detrimentally affects the golfer's swing. Although the cushioning layers of conventional golf shoes reduce the stress to some extent, the limited nature of the relief can result in fatigue which adversely affects performance.

SUMMARY OF THE INVENTION

Briefly stated, the invention in a preferred form is a cushioning system for golf shoe which includes a footbed and a lasting board, each having a sole region, an arch region, and a heel region. A receptacle is formed in the heel region of the lasting board. The footbed includes an upper layer which is engaged by the foot of a golfer and a cushion layer disposed below the upper layer, each of which extend the length of the footbed. A rigid bottom layer is disposed below the cushion layer in the heel region. The cushion layer is composed of a compressible material and defines a recess in the heel region which cooperates with an opening in the bottom layer to define a receptacle which is opposite to the receptacle of the lasting board. First and second cushioning elements are disposed within the receptacles of the lasting board and the footbed, respectively.

The first cushioning element is composed of a polymeric foam material. The second cushioning element has a flexible outer shell defining a cavity and a compressible gel material disposed within the cavity. The outer shell of the second cushioning element includes upper and lower shell halves joined along an outwardly extending seam defining a flange. The flange extends out of the receptacle between the cushion layer and the bottom layer of the footbed.

The footbed also has an enhanced cushioning zone extending from the medial portion of the toe area of the forefoot region, across the ball portion of the forefoot region, and into the lateral portion of the arch region. The cushion layer in the enhanced cushioning zone has an upper portion and a lower portion defining a plurality of laterally and longitudinally spaced cushioning bumps extending downwardly from the upper portion. Preferably, the cushioning bumps form laterally and longitudinally extending rows of bumps. The lateral portion of the toe area and the medial portion of the arch area may have a plurality of openings extending through the footbed.

It is an object of the invention to provide a golf shoe which has a new and improved cushioning system.

It is also an object of the invention to provide a golf shoe which has a cushioning system that provides improved cushioning in the areas of the footbed that are subject to the greatest pressure.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DESCRIPTION OF THE PREFERRED EMBODIMENTS

The parent application, U.S. patent application Ser. No. 09/322,428 filed on May 28, 1999, herein incorporated by reference, disclosed a golf shoe footbed having an upper fabric layer, a middle layer composed of a relatively soft polymeric foam material, and a lower layer composed of a relatively firm polymeric foam material. The cushioning system of the '428 application included cushioning elements in areas of the footbed which are subjected to greater pressure during walking and during a golf swing. Specifically, portions of the footbed lower layer in the area of the big toe, the metatarsal heads, and the lateral portion of the arch area were removed to form receptacles for receiving separate, softer, cushioning elements. A separate, softer, cushioning element was also disposed in the heel of the golf shoe, with the lower half of the cushioning element being received in a receptacle formed in the heel of the lasting board and the upper half of the cushioning element being received in a receptacle formed in the heel of the footbed.

Although the cushioning system of the '428 application provides a golf shoe which is superior to conventional golf shoes, it is relatively expensive to manufacture. A golf shoe having a cushioning system in accordance with the subject invention enjoys substantially the same benefits as a golf shoe having the cushioning system of the '428 application, while being less expensive to manufacture.

Figure 1:
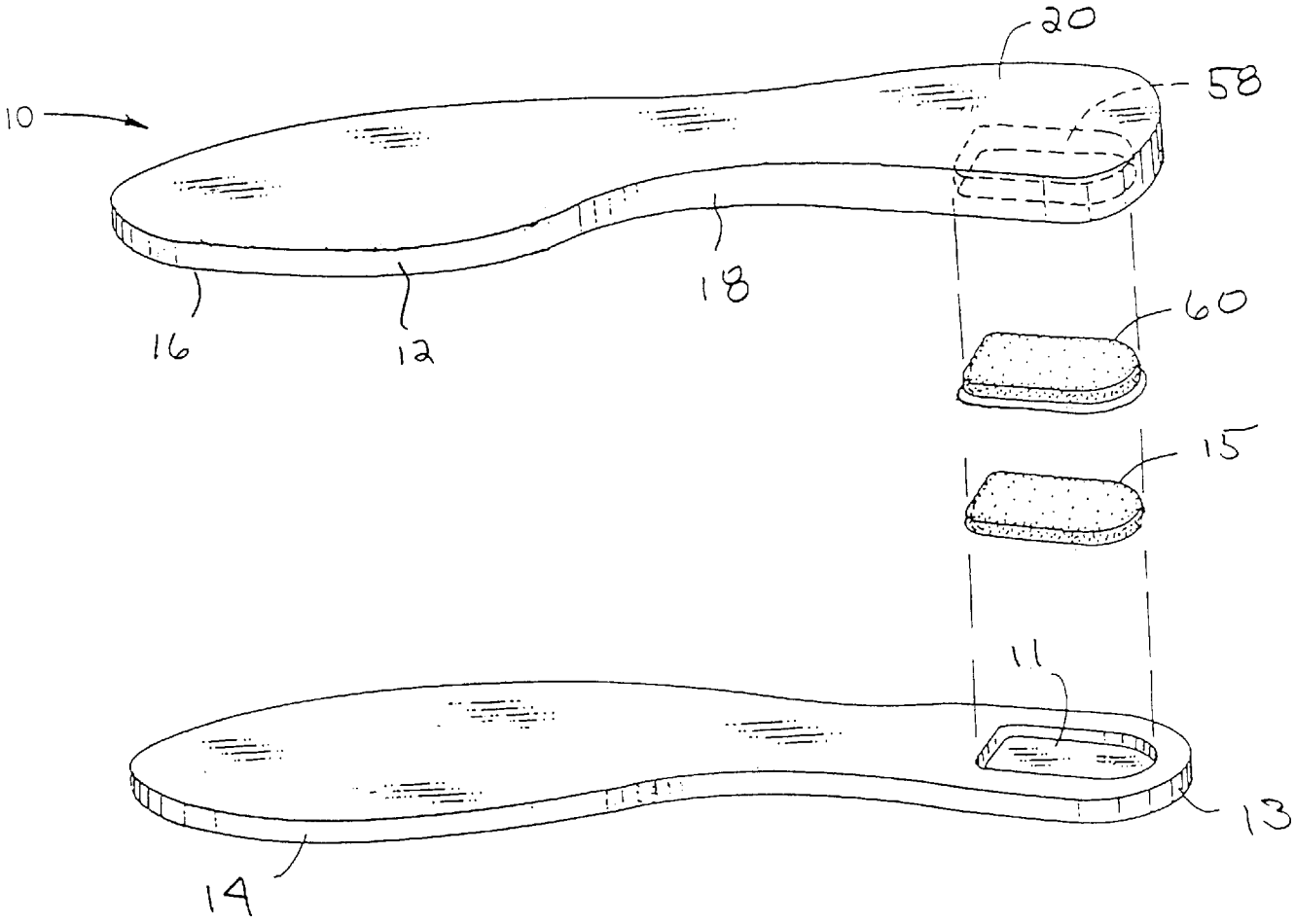
FIG. 1 is an exploded perspective view of a cushioning system in accordance with the present invention.

With reference to the drawings wherein like numerals represent like parts throughout the several figures, a cushioning system for a golf shoe in accordance with the present invention is generally designated by the numeral 10. An outsole (not shown) is mounted to an upper (not shown) to form the exterior shell of a golf shoe. The shoe upper and the outsole are well known in the art and may be comprised of any material suitable for use while playing golf. The golf shoe also includes a footbed 12, on which the golfer's foot rests, and a lasting board 14 disposed intermediate the footbed 12 and the outsole (FIG. 1).

The lasting board 14 is a relatively stiff member, supporting the entire foot and providing a means of diffusing the pressure induced by the golf spikes across the entire foot. The lasting board 14 may be composed of thermoplastic polyurethane (TPU), fiberboard, or other similar material. To provide additional cushioning for the golfer's heel a receptacle 11 is formed in the heel region 13 of the lasting board 14 for receiving a first cushioning element 15. Preferably, the first cushioning element 15 is composed of a relatively soft, polymeric foam material, for example ethyl-vinyl-acetate (EVA), having an Asker C hardness of 30° (±2°).

Figure 2:
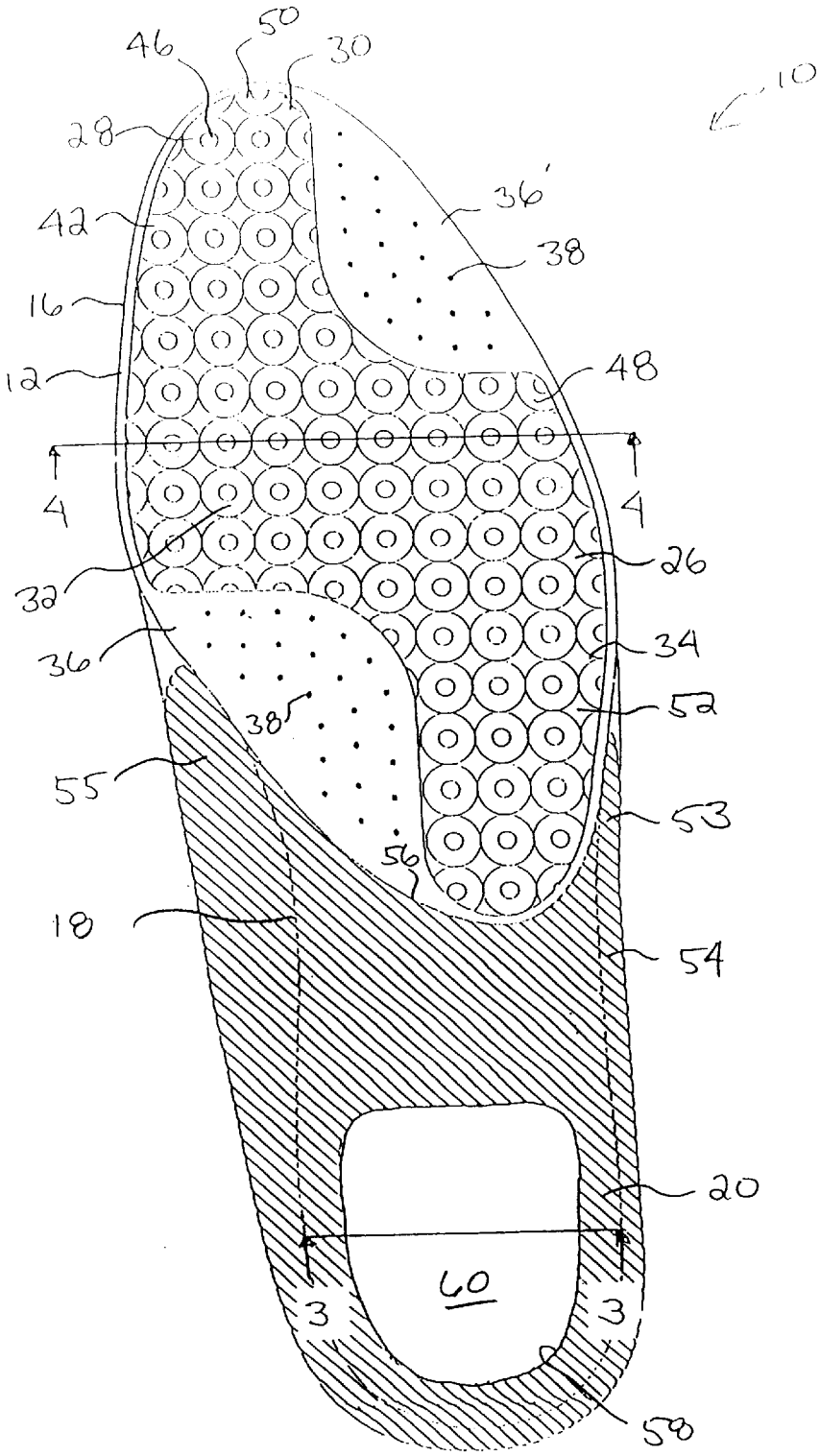
FIG. 2 is a bottom view of the footbed of FIG. 1.
Figure 4:
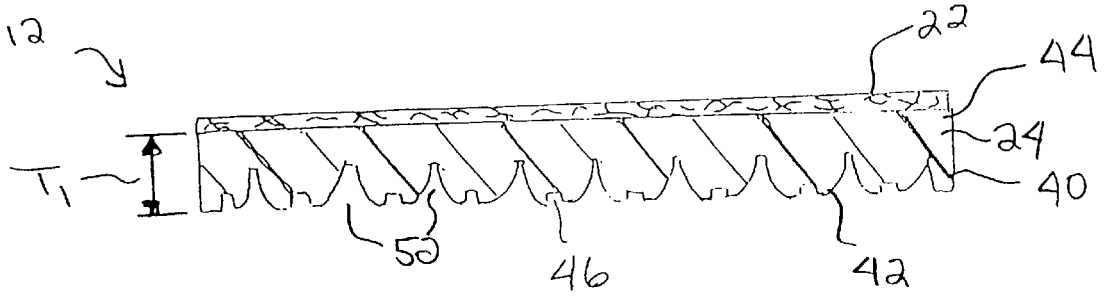
FIG. 4 is an enlarged cross-section view, taken along line 4—4 of the footbed of FIG. 2.

With reference to FIGS. 2 and 4, the footbed 12 includes a forefoot region 16, an arch region 18 and a heel region 20. The forefoot region 16 of the footbed 12 has two layers. An upper layer 22 composed of cloth or similar material provides a tear-resistant outer surface on which the golfer's foot rests. A lower, cushion layer 24, composed of a relatively soft polymeric foam material, provides a cushion for the forefoot portion of the sole of the foot. Preferably, the material of the cushion layer 24 is a polymeric foam material, for example EVA, having an Asker C hardness of 30° (±2°). Consequently, the cushioning system 10 of the subject invention relies entirely on the lasting board 14 to provide the required foot support and pressure diffusion.

The cushion layer 24 of the forefoot region 16 has a thickness T1 which is substantially equal to the total thickness of the middle and lower layers of the foot bed of the '428 application, thereby providing a greater cushioning effect. Preferably, T1 is substantially equal to 5.5 millimeters. The forefoot region 16 includes an enhanced cushioning zone 26 which extends from the medial portion 28 of the toe area 30, across the ball portion 32, and along the lateral portion 34 of the arch region 18 to provide further cushioning for the big toe, the metatarsal heads, and the lateral portion of the arch. The portions 36, 36' of the forefoot region 16 which lie outside of the enhanced cushioning zone 26 may have one or more openings 38 extending through the footbed 12 to facilitate air circulation. The openings 38 also provide for lateral displacement of the cushion layer 24 when pressure is applied to the footbed 12 and thereby increase the cushioning effect of such portions 36, 36'. The number, diameter, and location of the openings 38 (preferably 2.0 millimeters) are selected to provide the desired air circulation and cushioning effects.

In the enhanced cushioning zone 26, material is removed from the lower portion 40 of the cushion layer 24 to form a plurality of closely adjacent, laterally and longitudinally spaced, cushioning bumps 42 which extend downwardly from the upper portion 44 of the cushion layer 24. Preferably, each cushioning bump 42 has a central dimple 46 and the cushioning bumps 42 define laterally and longitudinally extending rows 48, 50. When the golfer's foot applies additional pressure in the enhanced cushioning zone 26, the foam material of the cushioning bumps 42 is laterally displaced into the voids 52 defined by the space between the cushioning bumps and into the dimples 46, thereby increasing the cushioning effect. When the additional pressure is removed, the cushioning bumps 42 resiliently return to their normal configuration such that the cushioning bumps 42 and the upper portion 44 of the cushion layer 24 comfortably support the golfer's forefoot.

Figure 3:
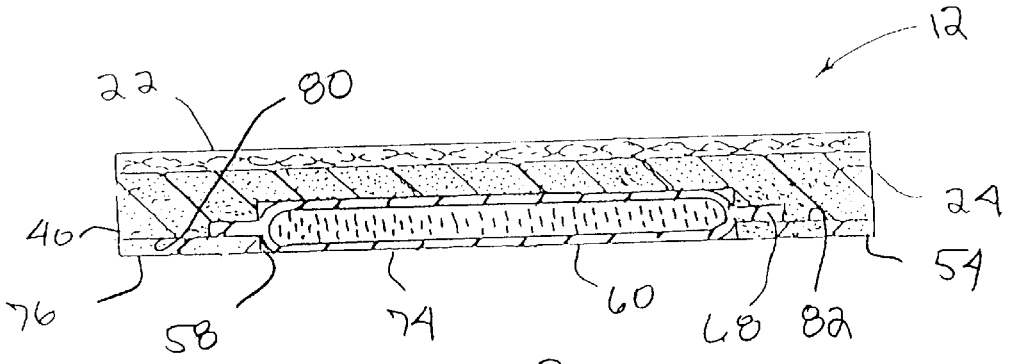
FIG. 3 is an enlarged cross-section view, taken along line 3—3 of the footbed of FIG. 2.

With reference to FIGS. 2 and 3, the upper layer 22 and the cushion layer 24 integrally extend from the forefoot region 16 into the arch and heel regions 18, 20. In addition, the heel region 20 and the lateral and medial portions 53, 55 of the arch region 18 include a third, bottom layer 54 of relatively rigid polymeric material underlying the cushion layer 24. The forward edge 56 of the bottom layer 54 is tapered to provide a smooth transition between the arch region 18 and the forefoot region 16. In addition, the forward edge 56 has an arcuate shape, with the medial and lateral sides extending forward of the middle portion to provide additional support to the wearer's arch. The bottom layer 54 is relatively thin, compared to the cushion layer 24, providing additional support in the arch and heel areas of the foot without substantially reducing the thickness of the cushion layer 24. Preferably, the material of the bottom layer 54 is polyethylene. The lower portion 40 of the cushion layer 24 and a portion of the bottom layer 54 in the heel portion are removed to form a receptacle 58 for receiving a second cushioning element 60.

Figure 5:
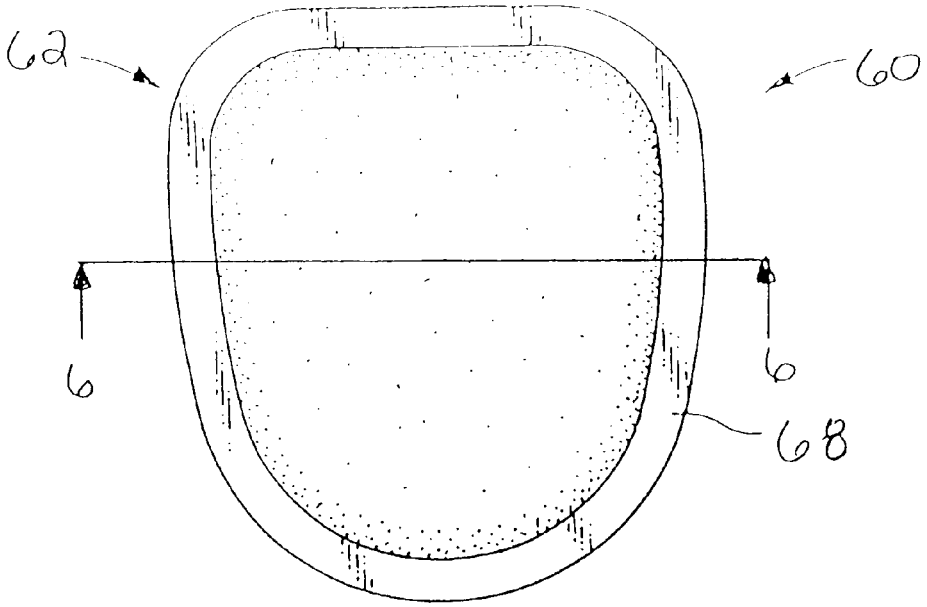
FIG. 5 is an enlarged top view of the heel cushioning pad of FIG. 1.
Figure 6:
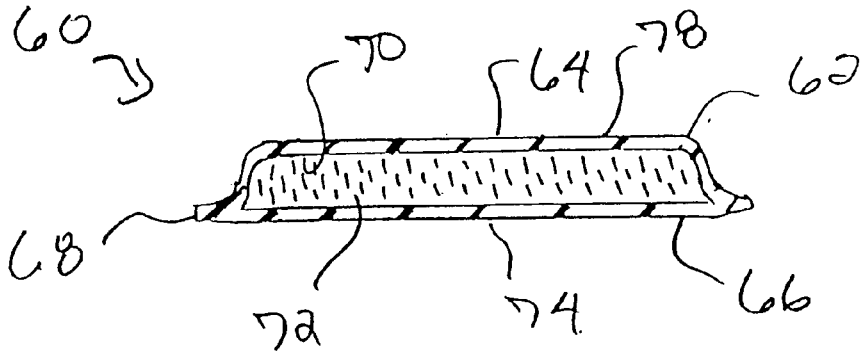
FIG. 6 is a cross-section view, taken along line 6—6, of the heel cushioning pad of FIG. 5.

With reference to FIGS. 5 and 6, the second cushioning element 60 comprises a flexible shell 62 having upper and lower flexible shell halves 64, 66 which are joined along a seam that forms a flange 68 extending outwardly from the side of the element 60. The upper and lower shell halves 64, 66 form a cavity 70 which contains a gel 72 which has shock-absorbing properties and cushioning properties which are superior to those of the material of the cushion layer 24.

With reference to FIG. 3, the second cushioning element 60 is disposed within the receptacle 58 such that the outer surface 74 of the lower shell half 66 is substantially co-planar with the lower surface 76 of the bottom layer 54. The outer surface 78 of the upper shell half 64 engages the lower surface 80 of the cushion layer 24 and, preferably, is mounted thereto by glue or similar means. The flange 68 is clamped between the lower surface 80 of the lower portion 40 of the cushion layer 24 and the upper surface 82 of the bottom layer 54, and, preferably, is mounted thereto by glue or similar means.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. A cushioning system for a golf shoe comprising:

a footbed having a forefoot region, an arch region, a heel region, an upper layer adapted for engagement by the foot of a golfer disposed in the forefoot, arch, and heel regions, a cushion layer disposed below the upper layer in the forefoot, arch, and heel regions, and a bottom layer disposed below the cushion layer in the heel region, the cushion layer being composed of a compressible material and defining a recess in the heel region, the bottom layer being composed of a substantially rigid material and defining an opening in the heel region, the recess of the cushion layer and the opening of the bottom layer cooperating to define a receptacle;

a lasting board disposed below the footbed, the lasting board having a heel region defining a receptacle disposed oppositely the receptacle of the footbed;

a first cushioning element disposed within the receptacle of the lasting board; and a second cushioning element disposed within the receptacle of the footbed.

2. The cushioning system of claim 1 wherein the first cushioning element is composed of a polymeric foam material and the second cushioning element has a flexible outer shell defining a cavity and a compressible gel disposed within the cavity.

3. The cushioning system of claim 2 wherein the outer shell of the second cushioning element includes upper and lower shell halves joined along an outwardly extending seam defining a flange, the flange extending out of the receptacle between the cushion layer and the bottom layer of the footbed.

4. The cushioning system of claim 1 wherein the forefoot region of the footbed includes a ball portion and a toe area having medial and lateral portions, and the arch region of the footbed includes medial and lateral portions, the footbed further having an enhanced cushioning zone extending from the medial portion of the toe area of the forefoot region, across the ball portion of the forefoot region, and at least partially into the lateral portion of the arch region.

5. The cushioning system of claim 4 wherein the cushion layer in the enhanced cushioning zone has an upper portion and a lower portion defining a plurality of laterally and longitudinally spaced cushioning bumps extending downwardly from the upper portion.

6. The cushioning system of claim 5 wherein at least some of the cushioning bumps define a central dimple.

7. The cushioning system of claim 5 wherein the cushioning bumps form laterally and longitudinally extending rows.

8. The cushioning system of claim 4 wherein the lateral portion of the toe area defines a plurality of openings extending through the footbed.

9. The cushioning system of claim 4 wherein at least a part of the medial portion of the arch region defines a plurality of openings extending through the footbed.

10. The cushioning system of claim 4 wherein the bottom layer extends at least partially into the lateral and medial portions of the arch region.

11. The cushioning system of claim 10 wherein within the arch region of the footbed, the bottom layer extends laterally and medially of the enhanced cushioning zone.

12. The cushioning system of claim 1 wherein the arch region of the footbed includes a lateral portion and a medial portion, the bottom layer extending at least partially into the lateral and medial portions of the arch region.

13. The cushioning system of claim 12 wherein the bottom layer has a forward end having an arcuate shape.

14. The cushioning system of claim 13 wherein the forward end of the bottom layer has a beveled edge.

15. A cushioning system for a golf shoe comprising:

a footbed having a forefoot region, an arch region, and a heel region, the forefoot region of the footbed including a ball portion and a toe area having medial and lateral portions, the arch region of the footbed including medial and lateral portions, the footbed further having an upper layer adapted for engagement by the foot of a golfer disposed in the forefoot, arch, and heel regions, a cushion layer disposed below the upper layer in the forefoot, arch, and heel regions, and a bottom layer disposed below the cushion layer in the heel region and the medial and lateral portions of the arch region, the cushion layer being composed of a compressible material and defining a recess in the heel region, the bottom layer being composed of a substantially rigid material and defining an opening in the heel region, the recess of the cushion layer and the opening of the bottom layer cooperating to define a receptacle; and a footbed cushioning element disposed within the receptacle having a flexible outer shell defining a cavity and a compressible gel material disposed within the cavity, the outer shell including upper and lower shell halves joined along an outwardly extending seam defining a flange, the flange extending out of the receptacle between the cushion layer and the bottom layer of the footbed.

16. The cushioning system of claim 15 wherein the footbed further has an enhanced cushioning zone extending from the medial portion of the toe area of the forefoot region, across the ball portion of the forefoot region, and at least partially into the lateral portion of the arch region, the cushion layer in the enhanced cushioning zone having an upper portion and a lower portion defining a plurality of laterally and longitudinally spaced cushioning bumps extending downwardly from the upper portion.

17. The cushioning system of claim 15 wherein the bottom layer extends laterally and medially of the enhanced cushioning zone in the arch region of the footbed.

18. The cushioning system of claim 15 further comprising a lasting board disposed below the footbed and a lasting board cushioning element, the lasting board having a heel region defining a receptacle disposed oppositely the receptacle of the footbed, the lasting board cushioning element being disposed within the receptacle of the lasting board.

19. The cushioning system of claim 18 wherein the lasting board cushioning element is composed of a polymeric foam material.

20. A cushioning system for a golf shoe comprising:

a footbed having a forefoot region, an arch region, and a heel region, the forefoot region of the footbed including a ball portion and a toe area having medial and lateral portions, the arch region of the footbed including medial and lateral portions, the footbed also having an upper layer adapted for engagement by the foot of a golfer disposed in the forefoot, arch, and heel regions, a cushion layer disposed below the upper layer in the forefoot, arch, and heel regions, and a bottom layer disposed below the cushion layer in the heel region and the medial and lateral portions of the arch region, the footbed further having an enhanced cushioning zone extending from the medial portion of the toe area of the forefoot region, across the ball portion of the forefoot region, and at least partially into the lateral portion of the arch region, the cushion layer being composed of a compressible material and defining a recess in the heel region, the bottom layer being composed of a substantially rigid material and defining an opening in the heel region, the recess of the cushion layer and the opening of the bottom layer cooperating to define a receptacle;

a lasting board disposed below the footbed, the lasting board having a heel region defining a receptacle disposed oppositely the receptacle of the footbed;

a first cushioning element composed of polymeric foam material disposed within the receptacle of the lasting board; and a second cushioning element disposed within the receptacle of the footbed, the second cushioning element having a flexible outer shell defining a cavity and a compressible gel material disposed within the cavity.

* * * * *